US005349938A

United States Patent [19]

Farrell

[11] Patent Number: 5,349,938

[45] Date of Patent: Sep. 27, 1994

[54] RECIPROCATABLE BARREL PNEUMATIC GUN

[76] Inventor: Kenneth R. Farrell, 19202 SE. 184th St., Renton, Wash. 98058

[21] Appl. No.: 52,084

[22] Filed: Apr. 22, 1993

[51] Int. Cl.[5] ..... F41B 11/00

[52] U.S. Cl. ..... 124/73; 124/72; 124/76

[58] Field of Search ..... 124/70–74, 124/76, 56

[56] References Cited

U.S. PATENT DOCUMENTS

| | | | |
|---|---|---|---|
| 2,505,972 | 5/1950 | Johnson . | |
| 2,554,116 | 5/1951 | Monner . | |
| 2,817,328 | 12/1957 | Gale . | |
| 2,940,438 | 6/1960 | Merz . | |
| 3,103,212 | 9/1963 | Merz . | |
| 3,177,863 | 4/1965 | Spack . | |
| 3,204,625 | 9/1965 | Shepherd . | |
| 3,612,026 | 10/1971 | Vadas . | |
| 3,788,298 | 1/1974 | Hale . | |
| 4,147,152 | 4/1979 | Fischer et al. | 124/76 |
| 4,531,503 | 7/1985 | Shepherd | 124/76 |
| 4,819,609 | 4/1989 | Tippmann | 124/72 |
| 4,936,282 | 6/1990 | Dobbins et al. | 124/74 |
| 5,063,905 | 11/1991 | Farrell | 124/72 |
| 5,257,614 | 11/1993 | Sullivan | 124/73 |

*Primary Examiner*—Randolph A. Reese
*Assistant Examiner*—John A. Ricci
*Attorney, Agent, or Firm*—Michael J. Folise

[57] ABSTRACT

A semiautomatic pneumatic gun is provided incorporating a reciprocatable striker-barrel which performs the normal functions of a barrel and a striker, sliding during firing from a cocked position in response to the urging of a striker power spring to impact upon a normally closed valve, which impact releases compressed gas for propelling a projectile from the gun and for recocking the gun. A slidable bolt serves to transfer the impact of the striker-barrel to the valve, and functions as a piston moving in a cylindrical recocking chamber in response to the urging of gas released by the valve to move the striker-barrel back to the cocked position.

12 Claims, 14 Drawing Sheets

RECIPROCATABLE BARREL PNEUMATIC GUN

TECHNICAL FIELD

The invention relates to pneumatic guns of the semiautomatic or automatic type. More specifically, the invention is related to devices for firing marking pellets, also known as paintballs, but may also be employed for firing other projectiles such as BBs, metallic pellets, or darts.

BACKGROUND OF THE INVENTION

It is previously known in the art to have semiautomatic pneumatic guns. In such guns, each pull of the trigger causes the release of compressed gas to propel a projectile from the gun. In a true semiautomatic, compressed gas also provides the motive force to return the gun to the cocked state.

In common with manually cocked guns, semiautomatics in general incorporate a gun frame, a grip, a barrel, a projectile chamber at a breech end of the barrel, a magazine of projectiles with a feed assembly for successively introducing individual projectiles into the projectile chamber, a mechanism to prevent the projectile then in the chamber from rolling forward when the gun in tilted downward, an operator actuatable trigger mechanism, a source of compressed gas, and an internal gas reservoir having at least one normally closed valve which opens briefly in response to trigger actuation, thereby releasing compressed gas to propel the projectile then in the projectile chamber from the gun.

Some mechanism for sealing the projectile chamber against loss of the compressed gas released to propel the projectile will also generally be present in the gun. Typical sealing mechanisms are a longitudinally slidable bolt, a rotatable bolt, a transversely slidable clip, a slide, or a slidable barrel.

It is common in a semiautomatic pneumatic gun as shown in my U.S. Pat. No. 5,063,905 for the valve opening and release of compressed gas upon firing to be effected by the impact of a striker. In such a gun, the striker is restrained in a cocked position against the urging of a compressed striker power spring by a sear in the trigger mechanism. Trigger actuation withdraws the sear, releasing the striker to impact upon and briefly open one or more normally closed main valves. Gas released by the opening of the main valve or valves acts to propel the projectile then within the projectile chamber from the gun, and by virtue of a piston and cylinder mechanism which forms a recock chamber, to return the gun to the cocked state. A movable portion of the piston and cylinder mechanism may serve as the striker, or this movable portion may be linked to a separate striker.

Efficient utilization of the energy available from the compressed gas provided to the gun is advantageous to the user. Achieving efficiency imposes two generally opposed requirements on the mechanism used to achieve the recock-motion and main valve impact functions. First, the recock motion function is ideally achieved if the recock chamber is substantially sealed against the loss of compressed gas from the time the gas is introduced until the recock motion is completed. Second, the impact function is ideally achieved if striker motion from the cocked position to the position of impact is not impeded by the compression of residual gas within the chamber.

Mechanical simplicity is also a desirable goal in the design and manufacture of a compressed gas gun. Most prior art guns employ separate a barrel, hammer, and main valve. In addition, in semiautomatic guns in which gas pressure is utilized to recock the gun automatically, the hammer or striker and bolt are typically interconnected so as to move together thus increasing the friction generated within the gun. To reduce the mechanical complexity of gas-powered guns, it is known to utilize the barrel itself as a striker or hammer by providing a movable barrel which actuates the main valve when the trigger is depressed. U.S. Pat. No. 4,147,152 to Fischer et al., U.S. Pat. No. 4,531,503 to Shepherd, and U.S. Pat. No. 3,204,625 to Shepherd all describe gas-pressurized guns utilizing a moving barrel with the striker or hammer on the main valve. However, the incorporation of a true semiautomatic operation eluded the inventors of these devices. U.S. Pat. No. 2,817,328 to Gale is one example of a reciprocating barrel, semiautomatic compressed-gas gun. However, although this gun achieves semiautomatic operation in a reciprocating barrel gun, Gale forfeits use of the barrel itself as a striker or hammer thus reverting to a more complex mechanical structure while attempting to obtain the benefits of a mechanically less complex sliding barrel gun. Thus, a need exists for a reciprocating barrel/striker-fired pneumatic gun having a minimum number of moving parts which effectively utilizes the mechanical simplicity of a reciprocating barrel design while providing true semiautomatic operation.

SUMMARY OF THE INVENTION

It is therefore an object of this invention to provide a semiautomatic pneumatic gun wherein the barrel performs the impact function, thereby minimizing mechanical complexity, and improving gas utilization efficiency, manufacturability and maintainability. Further objects and advantages of the invention will become apparent from a consideration of the ensuing description and drawings. The invention achieves these objects and advantages by providing a gas-powered gun employing a reciprocating barrel or "striker-barrel" movable between a forwardly, cocked position and a rearwardly, firing position. A gas reservoir having a main valve and a recocking chamber for accepting compressed gas to recock the gun are also provided. In a preferred embodiment of the invention, the gun is provided with two distinct fluid channels. A first fluid channel communicates gas directly from the gas reservoir to the barrel for expelling a projectile. A second, separate and distinct fluid channel communicates gas from the gas reservoir to the recocking chamber for recocking the gun. The barrel effectively acts as a striker or hammer for opening the main valve. This structure is mechanically simple, facilitates inexpensive manufacturing of the gun, and is easily disassembled for field cleaning. The incorporation of two distinct fluid channels in the design allows for the relative proportions of gas directed to the barrel for expelling the projectile, and gas directed to the recocking chamber for recocking the gun to be finely tuned so as to utilize the pressure in the gas reservoir effectively.

In an alternate embodiment of the invention, a control valve is employed between the barrel and the gas reservoir to sequentially utilize gas for recocking purposes, and then utilize the same gas for expelling a projectile from the barrel. The second design advantageously reduces complexity further and ensures positive recocking of the gun even when the gas pressure in the reservoir is relatively low.

DESCRIPTION OF THE PREFERRED EMBODIMENTS

Figure 1:
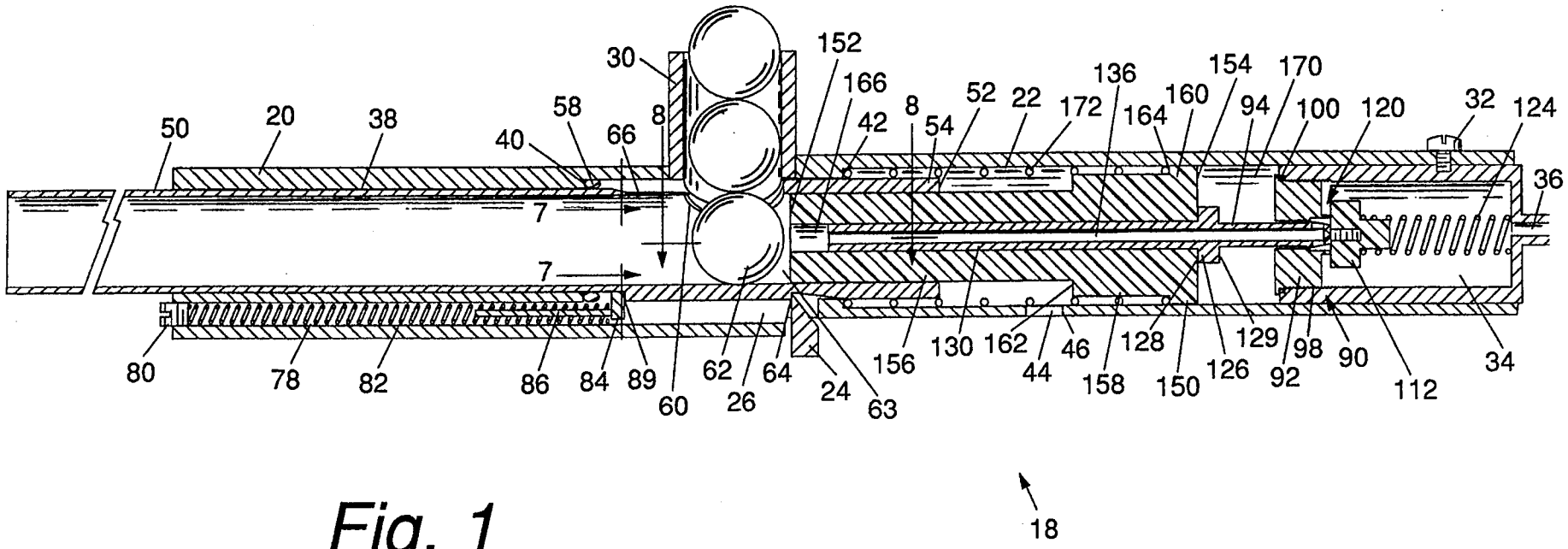
FIG. 1 shows a side cross sectional view of a first embodiment of the gun prepared to fire, with the striker-barrel held in the cocked position by the sear, and a projectile in position to be expelled forward through the striker-barrel.
Figure 7:
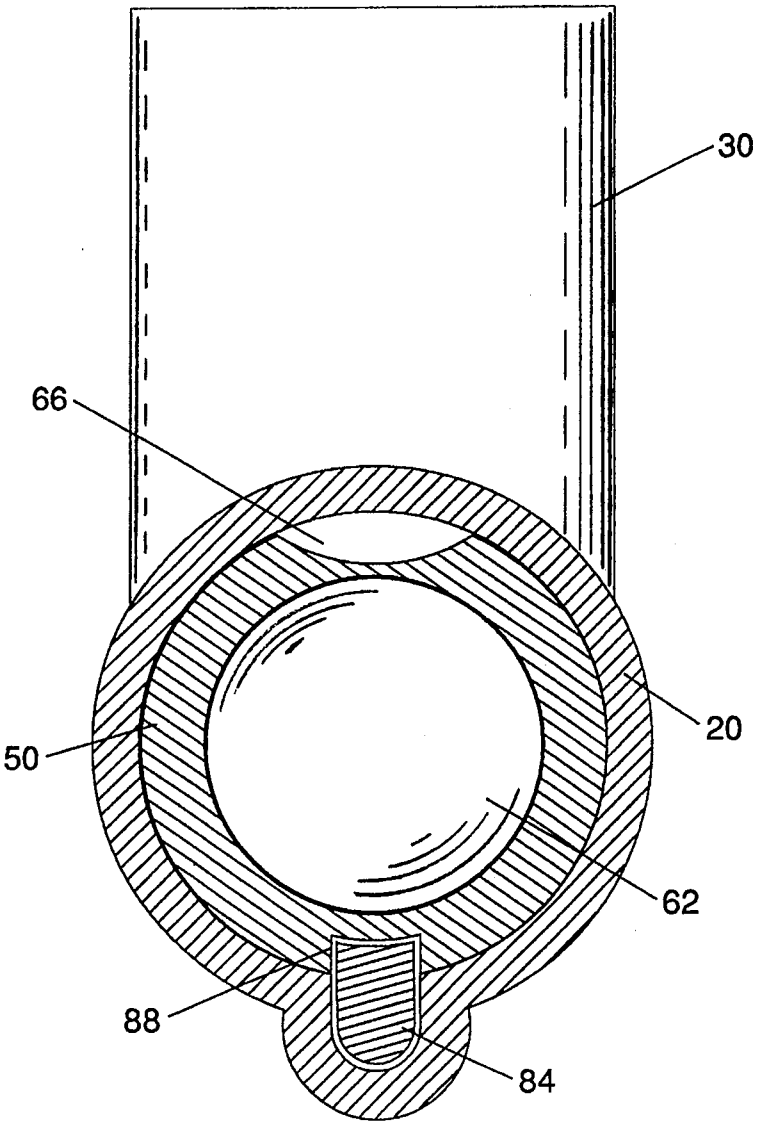
FIG. 7 shows a front cross sectional view taken along line 77 of FIG. 1, cutting through the projectile groove in the outer surface of the striker-barrel and the power spring follower arm.

A semiautomatic, gas-powered projectile gun, in accordance with the principals of the invention is generally indicated at reference numeral 18 in FIG. 1. The mechanism is shown cocked and ready to fire. The gun has a frame 20 with an internal cavity 22. Frame 20 has a conventional trigger mechanism (not shown) which incorporates an upwardly biased trigger sear 24. Sear 24 penetrates frame 20 through a sear/spring follower access slot 26. A conventional projectile magazine (not shown) connects to a projectile feed tube 30. Feed tube 30 can be oriented vertically, as shown in FIG. 7, or it can be tilted to one side to facilitate sighting the gun on a target.

Returning to FIG. 1, restrained at the rear of frame cavity 22 by a screw 32 is a compressed gas reservoir 34. The rear of reservoir 34 has a reservoir port 36 for attachment of a conventional source of compressed gas (not shown).

Forward within cavity 22 is a reduced diameter portion 38, rearwardly terminated forward of feed tube 30 in a buffer shoulder 40. Rearward of feed tube 30 within cavity 22 is a spring contact shoulder 42. Intermediate buffer shoulder 40 and reservoir 34, and penetrating the bottom of frame 20 is an exhaust port 44 having a rear end 46.

Figure 8:
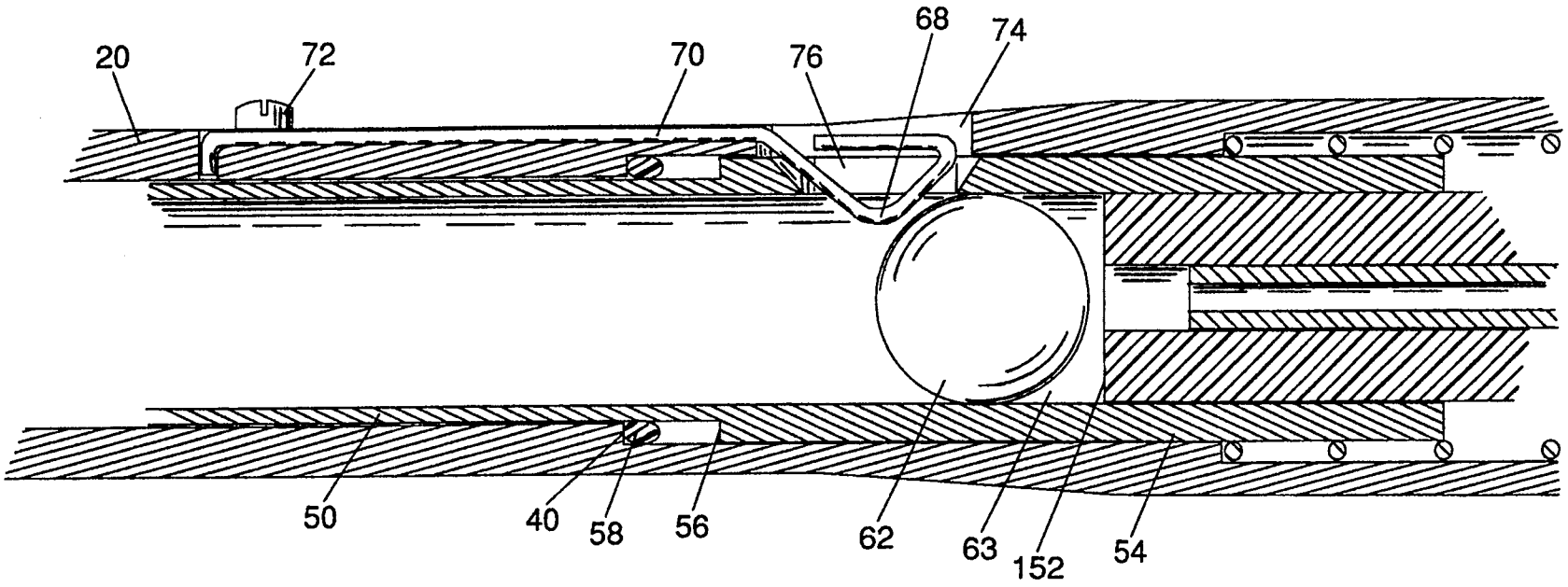
FIG. 8 shows a top cross sectional view taken along line 88 of FIG. 1, cutting through the projectile retention spring restraining a projectile in place for firing from the gun.

A generally tubular striker-barrel 50 of essentially uniform inside diameter, and having an open rear end 52, extends forward from and is slidable within reduced diameter portion 38 of cavity 22. Rearward on striker-barrel 50 is an enlarged portion 54, having a forward shoulder 56 which is best seen in FIG. 8, a top view of the gun in the same operating state as FIG. 1. Forward motion of striker-barrel 50 is limited by a resilient buffer ring 58 separating buffer shoulder 40 and forward shoulder 56.

Returning to FIG. 1, intermediate on enlarged portion 54, and penetrating to the interior of striker-barrel 50, is a projectile access opening 60. Opening 60 is in alignment with projectile feed tube 30 when striker-barrel 50 is in the cocked position as shown in FIG. 1, permitting a projectile 62 to enter a projectile chamber 63 within striker-barrel 50. External on enlarged portion 54 at the bottom of striker-barrel 50 is a sear notch 64.

Referring to FIGS. 1 and 7, a projectile groove 66 external on enlarged portion 54 extends forward from projectile access opening 60 nearly to forward shoulder 56 shown only in FIG. 8, and inward nearly to the inner surface of striker-barrel 50. Projectile groove 66 moderates the displacement of projectiles within feed tube 30 as striker-barrel 50 slides rearward when the gun is fired.

Referring to FIG. 8, projectile 62 is constrained from forward movement by a spring tip 68 of a projectile retention spring 70 of conventional design. Spring 70 is attached to the exterior of frame 20 by a screw 72. Spring tip 68 penetrates frame 20 through a frame slot 74, and it penetrates striker-barrel 50 through a striker-barrel slot 76. Slot 76 is tapered at each end to facilitate deflection of spring tip 68 out of slot 76 when striker-barrel 50 translates longitudinally within frame 20.

Referring to FIG. 1, parallel to reduced diameter portion 38 of cavity 22 in frame 20 is a power spring cavity 78 closed at tile forward end by a spring cavity screw 80. Within cavity 78 is a power spring 82. At the rear end of spring 82 is a spring follower arm 84 attached at the rearward end of a power spring follower rod 86. Referring to FIG. 7, arm 84 fits within a notch 88 at the bottom of striker-barrel 50, serving thereby to prevent rotation of striker-barrel 50. Referring again to FIG. 1, notch 88 has a rear surface 89 against which presses arm 84, serving thereby to transmit the rearward force exerted by spring 82 to striker-barrel 50.

Figure 2:
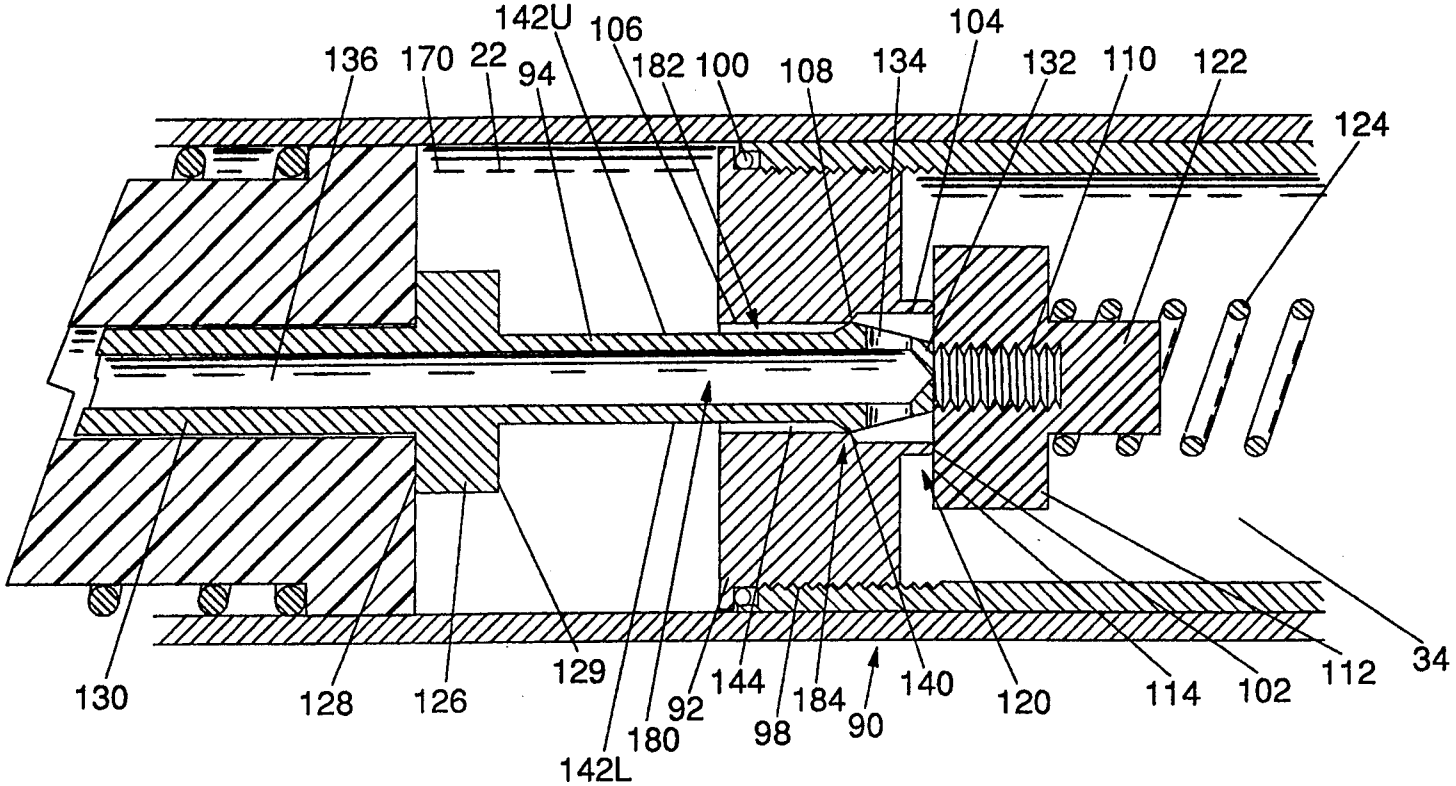
FIG. 2 shows an enlarged side cross sectional view of the valve assembly of the first embodiment, in the same operational state as FIG. 1.

Referring to enlarged view FIG. 2, at the forward end of gas reservoir 34 is a normally closed valve assembly 90, incorporating a valve body 92, and a valve tube 94. An internal thread 98 forward in gas reservoir 34 engages correspondingly threaded valve body 92. The joint between reservoir 34 and valve body 92 is sealed by a resilient O-ring 100.

On valve body 92 is an annular valve seat 102 in fluid communication with reservoir 34. Axially penetrating valve body 92, and extending forward from valve seat 102 is a rear bore 104. Extending forward from the forward end of rear bore 104 to cavity 22 is a forward bore 106. Forward bore 106 is concentric with and of smaller diameter than rear bore 104, forming thereby a secondary valve body shoulder 108.

Valve tube 94 passes through and is longitudinally translatable within internal bores 104 and 106. Rearward on valve tube 94 is a threaded end portion 110, onto which fits a correspondingly threaded resilient cup seal 112. Cup seal 112 has a forward face 114 sealingly engageable on valve seat 102. Cup seal 112 and valve seat 102 together form a main valve 120 which controls the release of all compressed gas from reservoir 34.

Rearward on cup seal 112 is a reduced diameter portion 122 engaged by the forward end of a valve spring 124. The rear end of valve spring 124 impinges on the rear surface of reservoir 34, and in combination with the compressed gas in reservoir 34 serves to urge cup seal 112 toward valve seat 102.

Intermediate on valve tube 94 is an enlarged section 126 with a forward shoulder 128 and a rearward shoulder 129. Forward of shoulder 128 is a valve tube forward section 130 of constant outside diameter.

Forward of threaded end portion 110 of valve tube 94 is a tapered section 132, penetrated by a transverse passageway 134. Open at the forward end of valve tube 94, and extending rearward to transverse passageway 134, is an internal bore 136. Transverse passageway 134 and internal bore 136 are in fluid communication.

Figure 5:
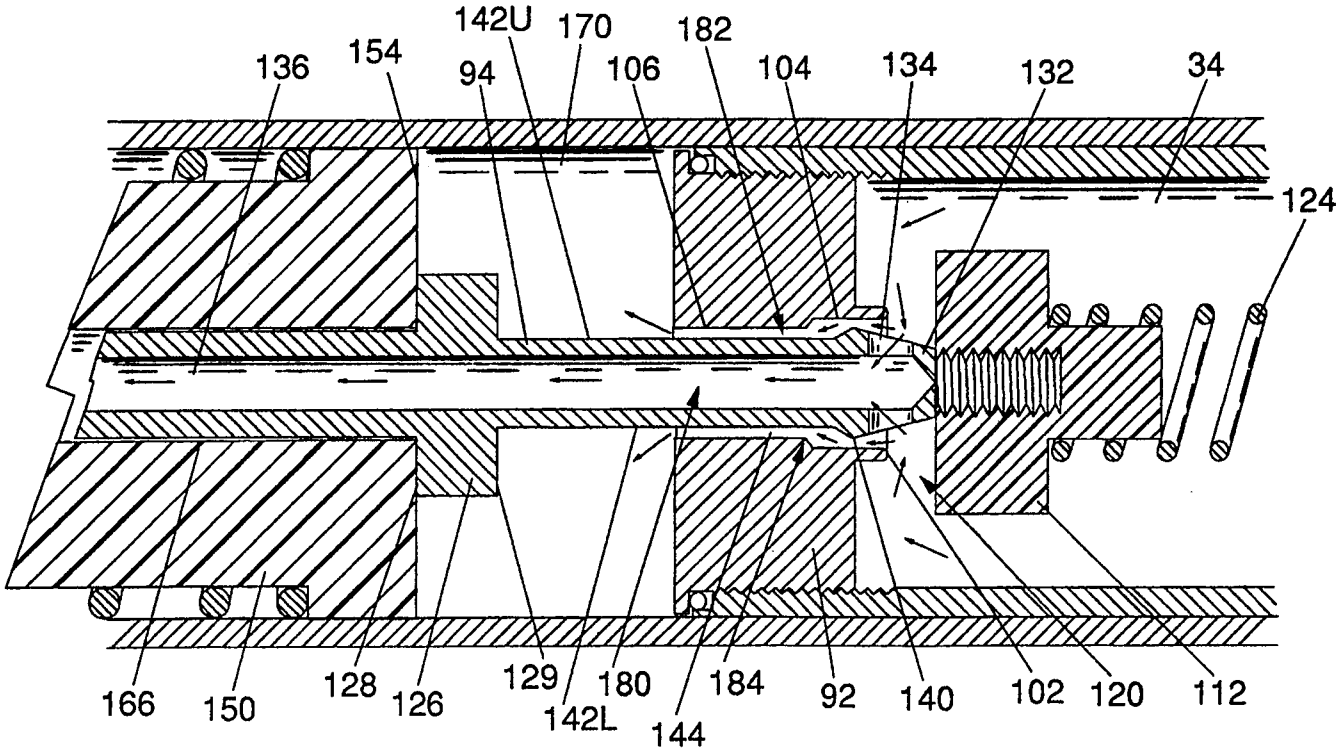
FIG. 5 shows an enlarged side cross sectional view of the valve assembly of the first embodiment, in the same operational state as FIG. 4, with small arrows indicating gas flow.

Referring to FIGS. 2 and 5, circumferential on valve tube 94 and forward of tapered section 132 is a secondary shoulder 140 which fits slidably in and substantially seals forward bore 106. The longitudinal location of shoulder 140 along valve tube 94 is established to place shoulder 140 inside of rear bore 104 when valve 120 is open, as shown in FIG. 5, and inside of forward bore 106 when main valve 120 is closed, as shown in FIG. 2.

Extending forward from shoulder 140 to enlarged section 126 is a section 142 of valve tube 94. Exterior on section 142 are milled flats, of which 142U and 142L shown in FIGS. 2 and 5 are representative examples, forming thereby a passageway 144 within forward bore 106. Passageway 144 can alternatively be provided by one or more grooves. It can also be provided by reducing the diameter of section 142 to obtain an annular void between bore 104 and section 142, with the potential disadvantage of excessive lateral motion of valve tube 94 within bore 106.

Referring again to FIG. 1, forward of reservoir 34 is a bolt 150, having a forward face 152, a rear face 154, and a forward section 156, an intermediate section 158, and a rear section 160 of successively larger outside diameters. Intermediate section 158 terminates forward in a striker-barrel impact shoulder 162. Rear section 160 terminates forward in a spring contact shoulder 164. A bolt longitudinal bore 166 extends axially through bolt 150 from forward face 152 to rear lace 154. Bolt 150 is preferably constructed of a plastic such as nylon, rather than metal, to reduce the mass of the part.

Bore 166 of bolt 150 fits slidably around valve tube forward section 130, and is of smaller diameter than valve tube enlarged section 126. Forward section 156 of bolt 150 fits slidably within and substantially seals striker-barrel 50. Rear section 160 of bolt 150 fits slidably within and substantially seals cavity 22, completing thereby a recocking gas chamber 170 intermediate rear bolt face 154 and valve body 92.

The longitudinal position of exhaust port 44 on frame 20 is established so that when striker-barrel 50 is forward in the cocked position as shown in FIG. 1, and bolt 150 is also forward with impact shoulder 162 in contact with rear end 52 of striker-barrel 50, rear lace 154 of bolt 150 is just forward of rear end 46 of exhaust port 44 (a bolt position not shown in the drawings), providing thereby a passageway for compressed gas to escape from recock gas chamber 170.

A bolt spring 172 impinges at the forward end on spring contact shoulder 42 of frame 20, and at the rearward end on spring contact shoulder 164 of bolt 150, serving thereby to urge bolt 150 rearward within frame 20. When the gun is cocked and ready to fire, as in FIG. 1, bolt 150 and valve tube 94 are in longitudinal contact, with rear face 154 of bolt 150 resting against shoulder 128 of valve tube 94. Also, the forward face 152 of bolt 150 is immediately rearward of projectile 62 within striker-barrel 50.

Referring to FIG. 5, small arrows illustrate the flow of compressed gas when cup seal 112 is not engaged on valve seat 102, so that main valve 120 is open. Transverse passageway 134, internal bore 136, and the forward portion of bolt longitudinal bore 166 shown in FIG. 4, form a primary channel 180 for the passage of compressed gas from reservoir 34 to the region immediately rearward of projectile 62.

Referring to FIG. 5, rear bore 104 surrounding valve tube 94, and passageway 144 within forward bore 106 form a secondary channel 182 for the passage of compressed gas to recocking gas chamber 170. Secondary shoulder 140, and internal bore 106, form a secondary valve 184 which controls the flow of compressed gas through secondary channel 182. When cup seal 112 is not engaged on valve seat 102, secondary shoulder 140 is within rear bore 104, opening secondary valve 184 and allowing compressed gas to flow into recocking chamber 170. When cup seal 112 is engaged on valve seat 102, as in FIG. 2, secondary shoulder 140 is within forward bore 106, closing secondary valve 184 and blocking compressed gas then within recocking chamber 170 from escaping via secondary channel 182 to primary channel 180.

With the elements of the gun described, the manner of operation will be clarified. FIG. 1 shows the gun ready to fire. Bolt 150 is held in longitudinal contact with valve tube 94 by the rearward urging of bolt spring 172, with rear face 154 of bolt 150 resting against forward shoulder 128 of valve tube 94. Cup seal 112 is urged forward by the pressure of the gas in reservoir 34, and by the urging of valve spring 124, so that main valve 120 is held closed, preventing the escape of compressed gas from reservoir 34. Striker-barrel 50 is restrained in the cocked position against the rearward urging of compressed power spring 82 by trigger sear 24 inserted in sear notch 64. Projectile 62, having entered projectile chamber 63 via teed tube 30 and access opening 60, is held in place for firing immediately forward of bolt forward face 152 by tip 68 of spring 70, as shown in FIG. 8.

Figure 3:
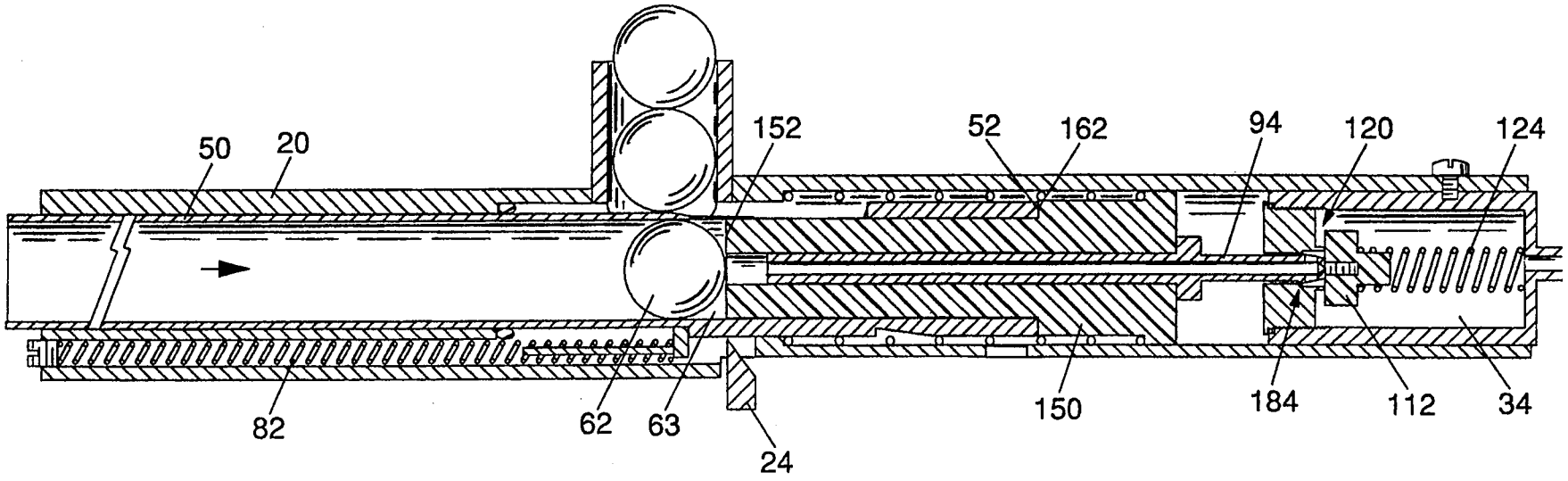
FIG. 3 shows a side cross-sectional view of the first embodiment, after the striker-barrel has been released by the sear and the striker-barrel has traveled rearward to the position where the striker-barrel has just impacted on the bolt.

Referring to FIG. 3, the operator initiates firing by actuating the trigger mechanism (not shown), causing trigger sear 24 to translate downward, releasing striker-barrel 50 to move rearward as shown by the large arrow in response to the urging of power spring 82. With continued rearward movement, striker-barrel 50 and bolt 150 make longitudinal contact, with rearward end 52 of striker-barrel 50 impacting on shoulder 162 of bolt 150.

Figure 4:
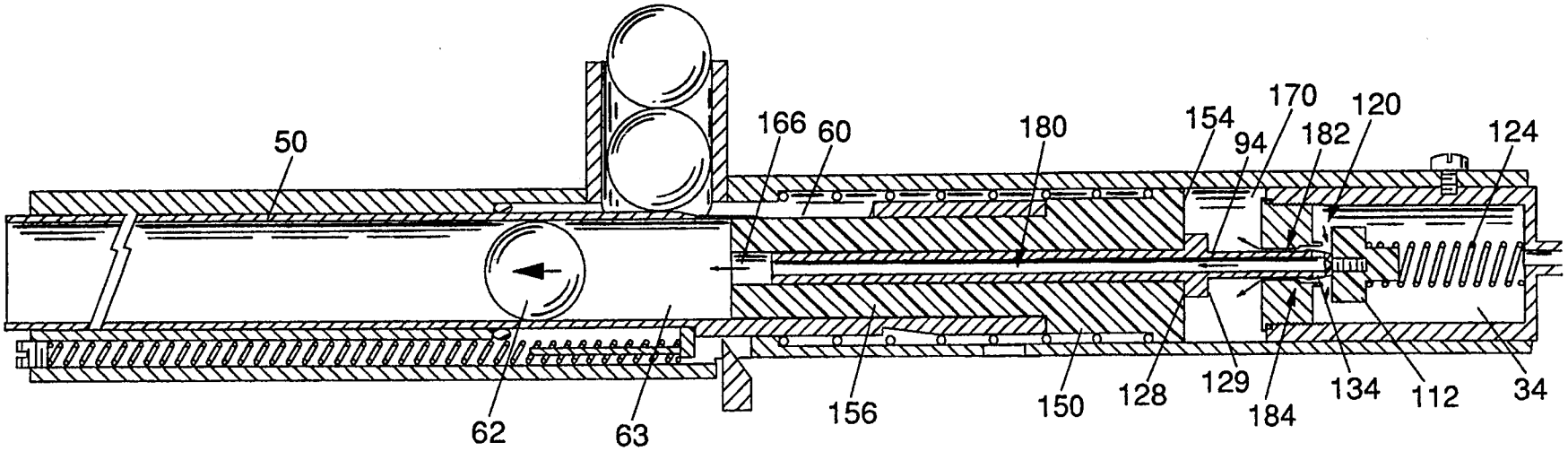
FIG. 4 shows a side cross sectional view of the first embodiment, with the striker-barrel nominally at its most rearward or firing position, with the main valve open and the projectile just beginning to move forward in the striker-barrel.

With striker-barrel 50, bolt 150, and valve tube 94 now in longitudinal contact, the inertia of rearward moving striker-barrel 50, plus the continued rearward urging of power spring 82, urge bolt 150 and valve tube 94 rearward. The forces urging cup seal 112 and attached valve tube 94 forward, namely the compressed gas in reservoir 34 acting on cup seal 112 and the forward urging of valve spring 124, are momentarily overcome. Valve tube 94 and cup seal 112 move rearward, opening main valve 120 and secondary valve 184 as shown in FIGS. 5 and 4. With valves 120 and 184 open, compressed gas flows through primary and secondary channels 180 and 182, as shown by the small arrows in both figures.

The gas which passes through primary channel 180 flows to the rear of projectile 62, urging it forward in striker-barrel 50 as shown by the large arrow in FIG. 4. Forward section 156 of bolt 150 is now adjacent to projectile access opening 60, substantially sealing opening 60 against the loss of the compressed gas which is acting to urge projectile 62 forward.

Referring again to FIGS. 4 and 5, the gas which passes through secondary channel 182 flows into recocking gas chamber 170, where it acts against rear shoulder 129 and rear lace 154 to urge valve tube 94, bolt 150 and striker-barrel 50 which are in longitudinal contact, to stop moving rearward and to instead move forward. Valve spring 124, the compressed gas in reservoir 34 acting on cup seal 112, and drag due to compressed gas flowing forward through channels 180 and 182 also contribute to urging valve tube 94, cup seal 112, striker-barrel 50, and bolt 150 forward so long as the longitudinal contact between bolt rear face 154 and valve tube forward shoulder 128 continues. With forward movement of valve tube 94 and cup seal 112, main valve 120 closes, preventing the release of additional compressed gas from reservoir 34. Secondary valve 184 also closes with forward movement of valve tube 94, preventing the backflow via secondary channel 182 of the charge of compressed gas now in recocking gas chamber 170.

Figure 6:
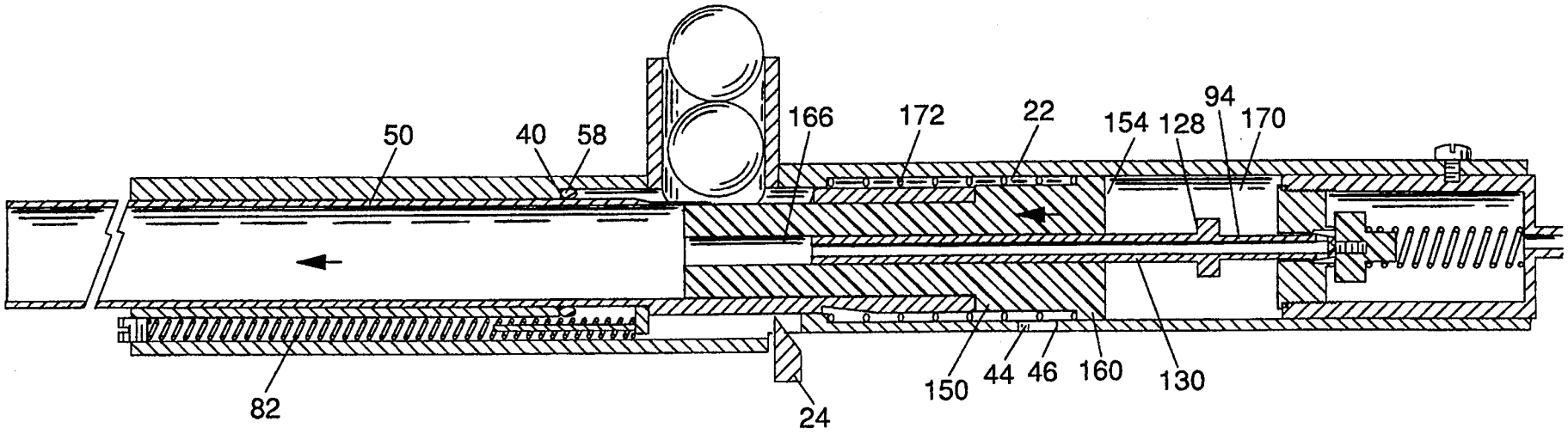
FIG. 6 shows a side cross sectional view of the first embodiment, part way through the recocking process, with the bolt and striker-barrel moving forward.

Referring now to FIG. 6, the charge of compressed gas in recocking gas chamber 170 continues to urge bolt 150 and striker-barrel 50 forward, as shown by the large arrows, until this motion is stopped by the rearward urging of power spring 82, or by buffer ring 58 between buffer shoulder 40 and forward shoulder 56 (shown only in FIG. 8). Once striker-barrel 50 moves forward to the cocked position shown in FIG. 1, sear 24 moves upward to engage sear notch 64, thereby restraining striker-barrel 50 in the cocked position until the operator again pulls the trigger.

Referring again to FIG. 6, the charge of compressed gas within recocking chamber 170 leaks out via several paths, with the relative amounts dependent on the fit of the various parts. Some gas leaks through the small space between bolt rear section 160 and the inner surface of frame cavity 22. When forward shoulder 128 of valve tube 94 is not in contact with bolt rear face 154, as shown for example in FIG. 6, some gas leaks through the space between valve tube forward section 130 and bolt longitudinal bore 166. When striker-barrel 50 has moved forward to the cocked position as shown in FIG. 1, and while bolt 150 is still forward in longitudinal contact with striker-barrel 50 (not shown in FIG. 1), so that bolt rear face 154 is forward of rear end 46 of exhaust port 44, some gas leaks out through port 44.

Suitable performance has been shown without port 44, the necessary leakage being provided by the other aforementioned leakage paths. Alternatively, the escape path provided by port 44 can be equivalently provided by a transverse passageway penetrating valve tube forward section 130 at nominally the same longitudinal location as port 44, or by one or more fiat exterior surfaces or grooves extending forward from this same longitudinal location on the exterior of section 130, so that gas then in recock chamber 170 can escape via longitudinal bore 166 and striker-barrel 50.

Alter sufficient gas escapes from chamber 170, bolt 150 begins moving rearward in response to the urging of bolt spring 172, finally returning to the position of rest in longitudinal contact with valve tube 94 shown in FIG. 1. The relatively slow leakage of the gas from chamber 170 serves to moderate the rearward velocity of bolt 150. By virtue of this moderate velocity, and by virtue of bolt 150 being constructed of a low density material, the impact of bolt 150 as it makes longitudinal contact with valve tube 94 is not sufficient to reopen main valve 120.

With bolt 150 and striker-barrel 50 now returned to the cocked position shown in FIG. 1, projectile access opening 60 is again aligned with projectile feed tube 30 and is no longer obstructed by forward section 156 of bolt 150, permitting another projectile to descend into striker-barrel 50. The gun is again ready to fire.

As can be understood from the foregoing description, the invention provides the advantage of fewer and simpler parts. Striker-barrel 50, with bolt 150 serving as a force transfer medium, eliminates the need for a separate barrel and striker. Striker-barrel 50 can be made of a length sufficient to extend forward of frame 20, thereby providing a grasping surface for cocking the gun and eliminating the need for a separate cocking handle.

As another advantage, the invention makes efficient use of the energy to the compressed gas which is provided during recocking to recompress power spring 82. Recocking gas chamber 170 is essentially sealed against the premature loss of compressed gas as striker-barrel 50 moves forward to the cocked position. Except for the small rearward motion of bolt 150 as main valve 120 opens, rearward motion of striker-barrel 50 during firing is not impeded by compressing residual gas within the recocking gas chamber.

Finally, manufacturing cost and maintenance are minimized by main valve 120 being the single valve, and O-ring seal 100 being the single other seal, required to restrain or control the full pressure of the compressed gas used in the gun.

Figure 9:
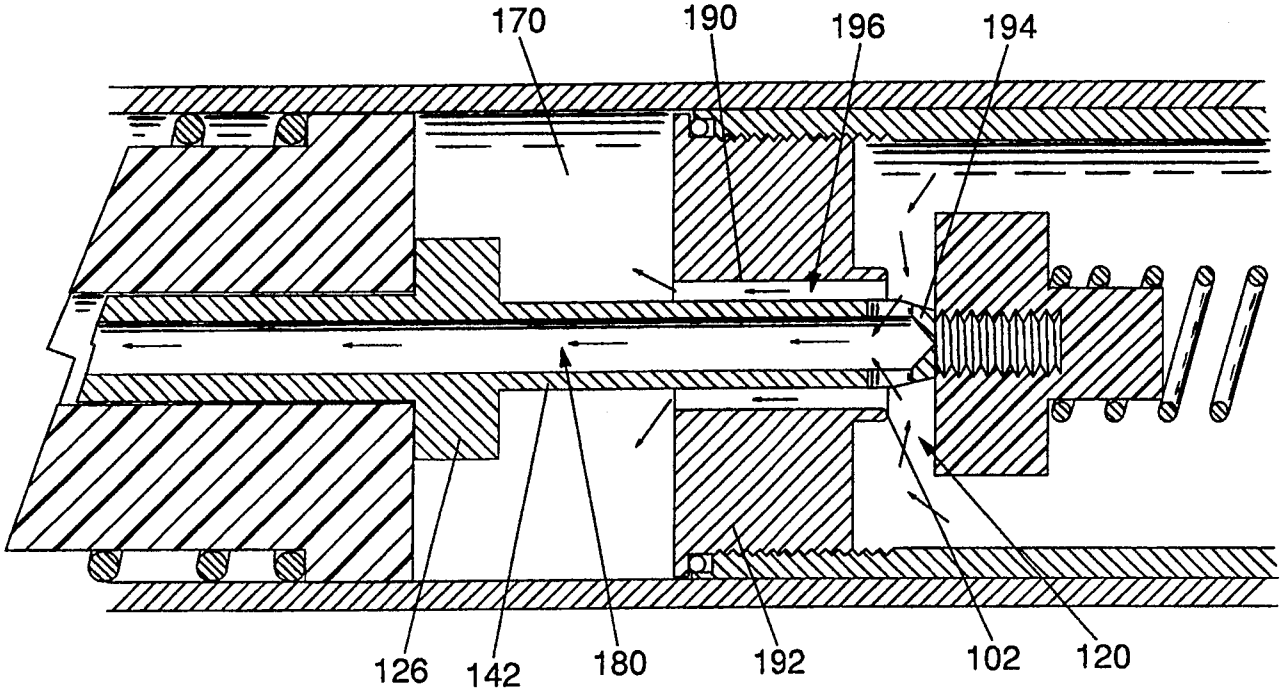
FIG. 9 shows a side cross sectional view of the valve assembly for a second embodiment, in the same operational state as FIG. 4, with small arrows indicating gas flow.

A second embodiment of the invention is shown in FIG. 9, in the same operating state as illustrated in FIG. 5. Where elements correspond to those of the first embodiment and perform the same function, they are identified by the same number. Main valve 120 and primary channel 180 are retained without change from the first embodiment. A single valve body bore 190 of constant diameter penetrates an alternative valve body 192. Valve tube section 142 of constant diameter extends rearward to an alternative tapered section 194, eliminating secondary shoulder 140 and secondary valve 184 of the first embodiment. Tube section 142 fits slidably within and does not seal bore 190, providing thereby an unvalved secondary channel 196 between valve seat 102 and recocking gas chamber 170.

Operation of the second embodiment is the same as for the first embodiment with the exception that in the absence of secondary valve 184 of the first embodiment, some of the compressed gas introduced into recocking chamber 170 for recocking the gun can leak via unvalved secondary channel 196 to primary channel 180, with the result that recocking is less efficient.

Figure 10:
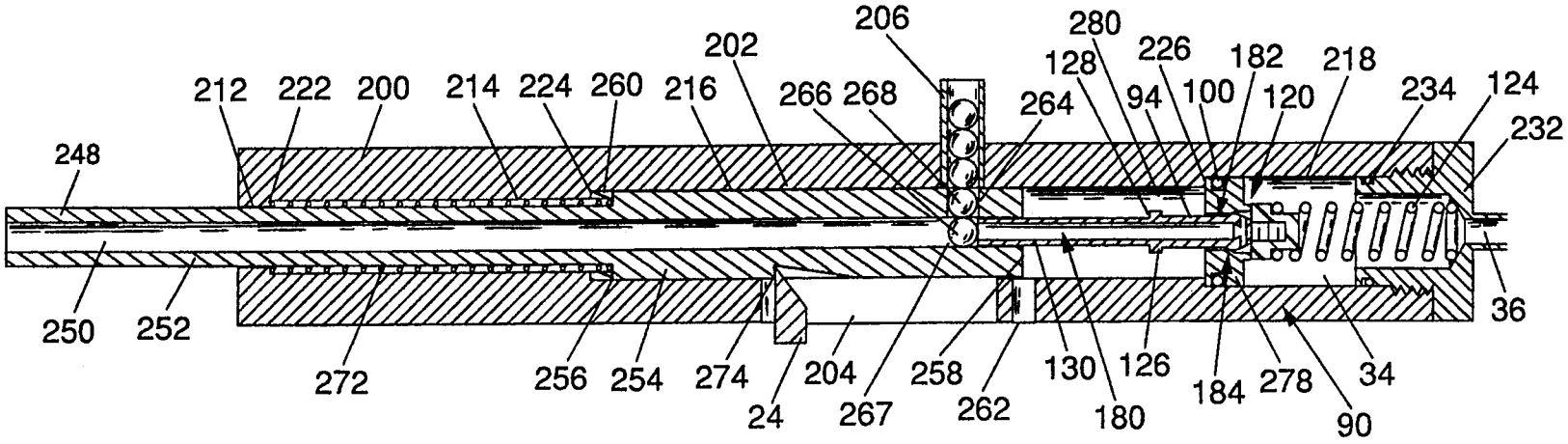
FIG. 10 shows a side cross sectional view of a third embodiment, in the same operational state as FIG. 1.
Figure 11:
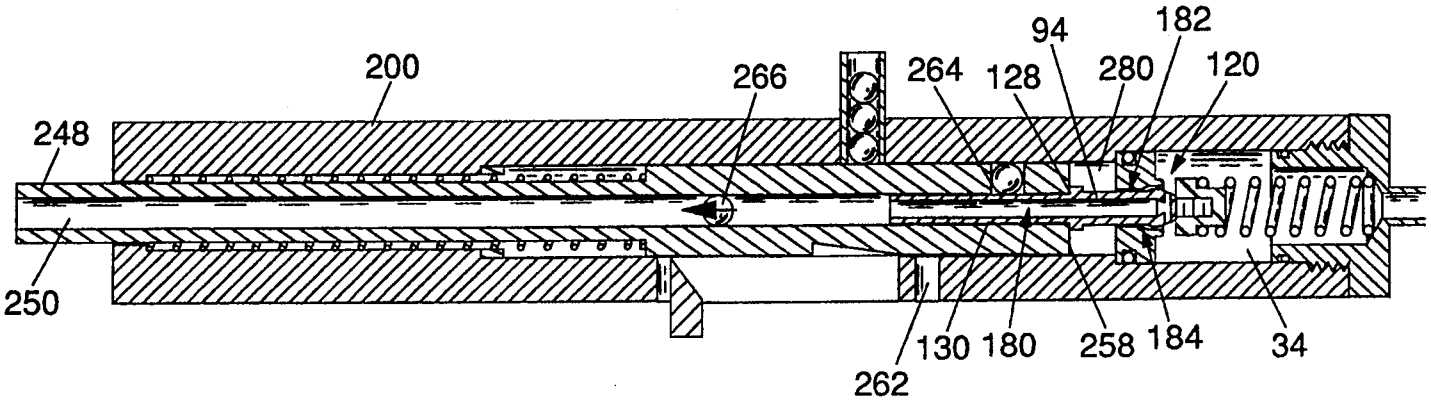
FIG. 11 shows a side cross sectional view of the third embodiment, in the same operational state as FIG. 4.

A third embodiment of the invention is shown in FIGS. 10 and 11. Where elements correspond to those of the first embodiment and perform the same function, they are identified by the same number.

The third embodiment is scaled for purpose of illustration to a size appropriate for firing steel BBs, which have a nominal diameter of 4.5 mm (0.177 inch). This is in contrast to the first and second embodiments, which are scaled for purpose of illustration to fire paintballs which have a nominal diameter of 17.3 mm (0.68 inch).

Referring to FIG. 10, which shows the gun cocked and ready to fire, the gun has a frame 200 with an internal cavity 202, a conventional trigger mechanism (not shown) with an upwardly biased trigger sear 24 which penetrates frame 200 through a sear access slot 204, and a conventional projectile magazine (not shown) connecting to a projectile feed tube 206.

Cavity 202 incorporates a first, second, third, and fourth cavity section 212, 214, 216, and 218 respectively, on a common axis and of successively larger inside diameter. First section 212 terminates rearwardly in a spring shoulder 222. Second section 214 terminates rearwardly in a buffer shoulder 224. Third section 216 terminates rearwardly in a valve body shoulder 226. Fourth section 218 is closed at the rear by a reservoir plug 232 threaded into frame 200. Plug 232 forms the rear of a compressed gas reservoir 34. A reservoir plug O-ring 234 provides a seal between plug 232 and fourth section 218. Penetrating reservoir plug 232 is a reservoir port 36 for attachment of a conventional source of compressed gas (not shown).

A generally tubular striker-barrel 248 with an internal bore 250 of essentially uniform diameter slides within and extends forward from frame 200. Striker-barrel 248 incorporates a forward section 252 and a rear section 254, concentric and of successively larger outside diameter. The wall thickness of section 254 is established to be substantially equal to the diameter of the projectiles to be fired from the gun.

Rear section 254 is terminated forward in a barrel shoulder 256 and rearward in a rearward end 258. Forward section 252 of striker-barrel 248 fits slidably within first section 212 of frame 200. Rear section 254 fits slidably within and substantially seals third section 216 of frame 200. Forward motion of striker-barrel 248 within frame 200 is limited by a resilient buffer ring 260 separating shoulders 224 and 256.

Third cavity section 216 is penetrated by an exhaust port 262. The longitudinal position of exhaust port 262 is established so that when striker-barrel 248 is forward in the cocked position as shown in FIG. 10, rear face 258 of striker-barrel 248 is just forward of exhaust port, providing thereby a passageway for compressed gas to escape from recock gas chamber 280.

Intermediate on rear section 254 of striker-barrel 248 is a projectile access passageway 264 penetrating to bore 250. Passageway 264 is in alignment with feed tube 206 when striker-barrel 248 is in the cocked position as shown in FIG. 10, permitting a projectile 266 to enter a projectile chamber 267 within bore 250, and a second projectile 268 to enter and remain within passageway 264.

Surrounding forward section 252 within cavity 202 is a power spring 272. Spring 272 impinges at the forward end on spring shoulder 222, and at the rearward end on barrel shoulder 256 serving thereby to urge striker-barrel 248 rearward.

External on rear section 254 at the bottom of striker-barrel 248 is a sear notch 274. Sear 24 engages sear notch 274 to restrain striker-barrel 248 in the cocked position as shown in FIG. 10.

At the forward end of gas reservoir 34 is a normally closed valve assembly 90 providing an equivalent valve tube 94, valve body O-ring 100, main valve 120, primary channel 180, secondary channel 182, and secondary valve 184 as in the first embodiment. Incorporated within assembly 90 is an unthreaded valve body 278, which differs from valve body 92 of the first embodiment by virtue of fitting slidably within fourth section 218. A valve spring 124, and the compressed gas within reservoir 34, serve to urge valve body 278 forward against valve body shoulder 226.

Intermediate on valve tube 94 is an enlarged section 126 with a forward shoulder 128. Forward of shoulder 128 is a valve tube forward section 130 of constant outside diameter. In this embodiment, section 130 is sized to slide within and substantially seal striker-barrel 248.

Within third section 216 to cavity 202 is a recocking gas chamber 280. Chamber 280 is closed at the front by rearward end 258 of striker-barrel 248, and at the rear by valve body 278.

To prevent projectile 266 within chamber 267 from rolling forward in bore 250 when the gun is tilted downward, a conventional spring comparable junction to retention spring 70 of the first embodiment can be added to frame 200, or to striker-barrel 248. Alternatively, the forward end of valve tube 94 can be magnetic, as is conventional in manually cocked BB guns.

Not shown in the drawings is a conventional handle on the side of striker-barrel 248, slidable in a slot (not shown) cut into the side of frame 200. This handle serves both for cocking the gun and to prevent rotation of striker-barrel 248 within frame 200. As an alternative to this handle, the forward end of striker-barrel 248 can be extended forward of frame 200 sufficiently to be grasped for cocking the gun, and a shallow groove the width of sear 24 can be cut into the bottom of striker-barrel section 254 forward of notch 274, so that upwardly biased sear 24 extending into this groove will serve to prevent rotation of striker-barrel 248.

With the elements of the third embodiment described, the manner of operation will be clarified. FIG. 10 shows the gun ready to fire. Main valve 120 is closed, and striker-barrel 248 is restrained in the cocked position by sear 24 engaged in sear notch 274.

The operator initiates firing by actuating the trigger mechanism (not shown), causing trigger sear 24 to translate downward, releasing striker-barrel 248 to move rearward in response to the urging of power spring 272. With continued rearward movement, striker-barrel 248 impacts on forward shoulder 128 of valve tube 94. As with the first embodiment this impact serves to move valve tube 94 rearward, opening main valve 120 and secondary valve 184 as shown in FIG. 11.

With valve 120 open, compressed gas flows through primary channel 180 to propel projectile 266 forward as indicated by the large arrow in FIG. 11. With striker-barrel 248 now rearward valve tube forward section 130 substantially seals projectile access passageway 264 against the escape of compressed gas.

With valves 120 and 184 open gas also flows through secondary channel 182 into recocking gas chamber 280, where it acts against rearward end 258 to urge striker-barrel 248 to move forward. With forward movement of striker-barrel 248, main valve 120 closes, preventing the release of additional compressed gas from reservoir 34. Secondary valve 184 also closes, preventing the backflow via secondary channel 182 of the charge of compressed gas now in recocking gas chamber 280.

The charge of compressed gas in recocking gas chamber 280 continues to urge striker-barrel 248 forward to the cocked position shown in FIG. 10. When it reaches this position, sear 24 moves forward to engage sear notch 274, thereby restraining striker-barrel 248 in the cocked position until the operator again pulls the trigger. As projectile passageway 264 moves forward of valve tube section 130 and comes into alignment with feed tube 206, projectile 268 moves into bore 250 of striker-barrel 248, and a new projectile moves into projectile access passageway 264. Compressed gas remaining as striker-barrel 248 reaches the cocked position shown in FIG. 10 can leak out through port 262.

As can be understood from the foregoing description, a gun built according to the third embodiment will make less efficient use of the compressed gas provided for recocking than will a gun built according to the first or second embodiment. This results because, in the absence of bolt 150 which was used in the first and second embodiments, striker-barrel 248 must partially compress residual gas within recocking gas chamber 280 as it moves rearward during firing to impact on shoulder 128 of valve tube 94. For some applications, the advantage of fewer parts provided by elimination of bolt 150 will be more beneficial than the associated loss in efficiency.

Figure 12:
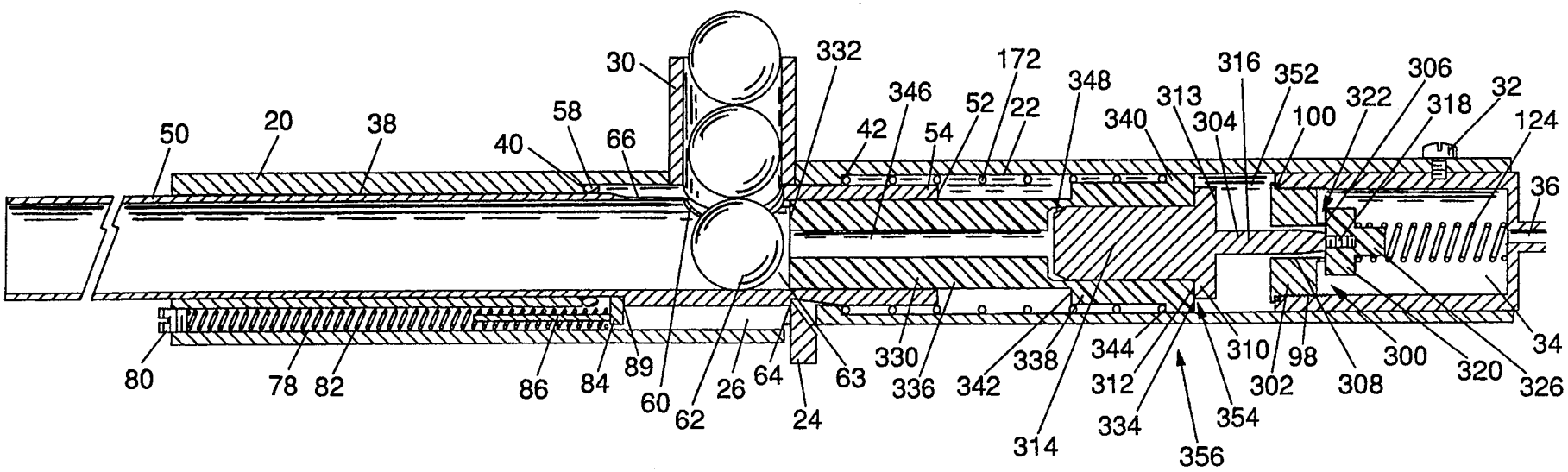
FIG. 12 shows a side cross sectional view of a fourth embodiment in the same operational state as FIG. 1.
Figure 13:
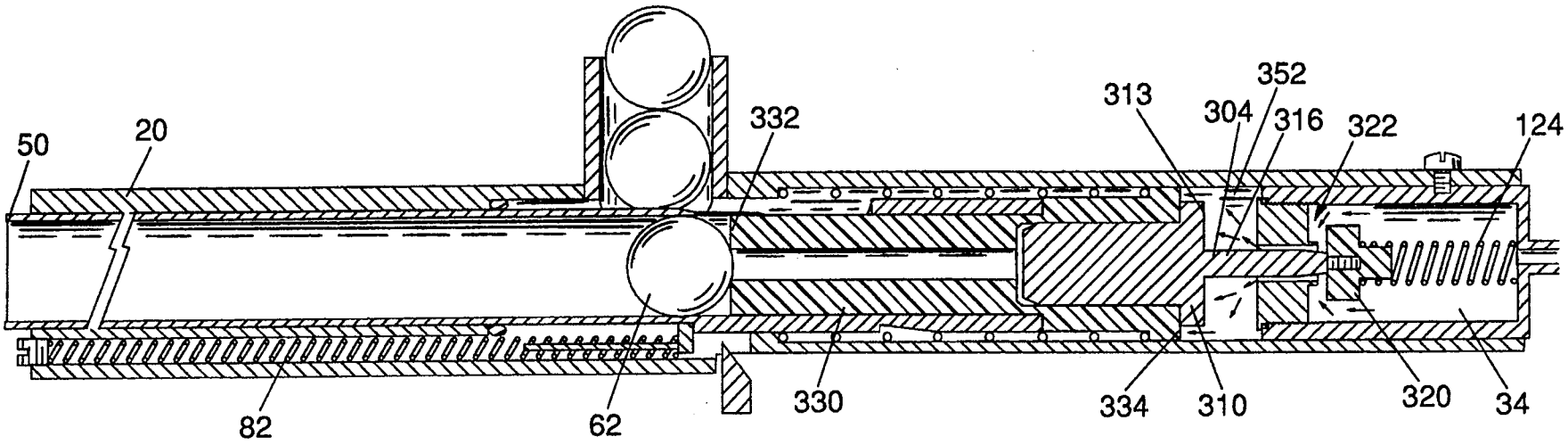
FIG. 13 shows a side cross sectional view of the fourth embodiment, with the striker-barrel nominally at its most rearward position and the main valve open.
Figure 14:
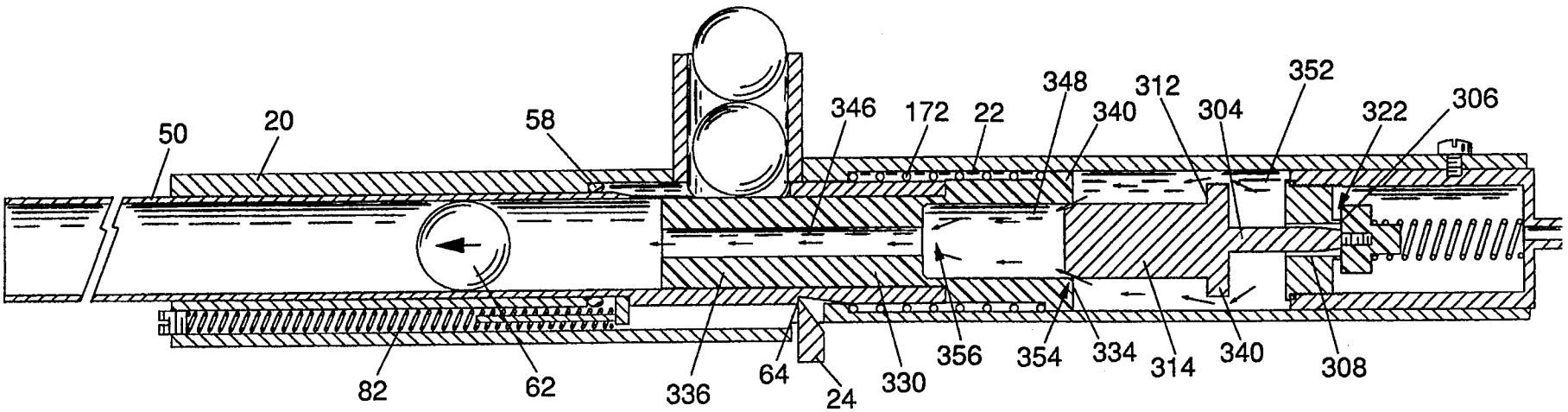
FIG. 14 shows a side cross sectional view of the fourth embodiment, with the striker-barrel nominally returned to the cocked position and a projectile moving forward in the striker-barrel.

A fourth embodiment of the invention is shown in FIGS. 12, 13 and 14. Where elements correspond to those of the first embodiment and perform the same function they are identified by the same number.

Referring to FIG. 12, which shows the gun cocked and ready to fire, unchanged from the first embodiment are the trigger assembly (not shown) which incorporates sear 24, frame 20 and associated sear slot 26, cavity 22, reduced diameter cavity portion 38, shoulders 40 and 42, the projectile magazine (not shown), projectile feed 30, power spring 82 within cavity 78, end screw 80, spring follower rod 86 and arm 84, and projectile 62 within projectile chamber 63. Exhaust port 44, optional on the first embodiment, is not present on frame 20 in the fourth embodiment. Unchanged within frame 20 are striker-barrel 50 and associated rearward end 52, enlarged portion 54, projectile access opening 60, projectile chamber 63, sear notch 64, and projectile groove 66. Also unchanged within or on frame 20 are buffer 40, and spring 172. Unchanged at the rear of cavity 22 is reservoir 34, sealed by O-ring 100, restrained in place by screw 32, and having port 36 for connection to a conventional compressed gas source (not shown). Unchanged and not visible in FIG. 12 are spring follower arm notch 88, visible in FIG. 7, and retention spring 70 and associated slots 74 and 76, visible in FIG. 8.

Referring again to FIG. 12, at the forward end of reservoir 34 is an alternative normally closed valve assembly 300, incorporating a valve body 302, and a valve pin 304. Internal thread 98 forward in reservoir 34 engages correspondingly threaded valve body 302. The joint between reservoir 34 and valve body 302 is sealed by resilient O-ring 100.

On valve body 302 is an annular valve seat 306 in fluid communication with reservoir 34. Axially penetrating valve body 302, and extending forward from valve seat 306, is a valve body bore 308.

On valve pin 304 is an enlarged section 310 having a forward shoulder 312 and a rearward shoulder 313. Extending forward from lace 312 is a first section 314, and extending rearward from enlarged section 310 is a third section 316. Section 316 passes through and is of smaller cross sectional area than bore 308, this smaller cross sectional area being achieved by making section 316 of smaller diameter than bore 308, or by cutting one or more grooves or flats along the length of section 316.

Rearward of third section 316 is a threaded end portion 318, onto which fits a correspondingly threaded resilient cup seal 320 sealingly engageable on valve seat 306. Cup seal 320 and valve seat 306 together form a main valve 322 which controls the release of all compressed gas from reservoir 34.

Rearward on cup seal 320 is a reduced diameter portion 324 engaged by the forward end of valve spring 124. The rear end of valve spring 124 impinges on the rear surface of reservoir 34, and in combination with the compressed gas in reservoir 34 serves to urge cup seal 320 toward valve seat 306.

Forward of enlarged section 310 is a bolt 330, having a forward face 332, a rearward lace 334 and a forward section 336, an intermediate section 338, and a rear section 340 of successively larger outside diameter. Intermediate section 338 terminates forward in a striker-barrel impact shoulder 342. Rear section 340 terminates forward in a spring contact shoulder 344. Bolt 330 is preferably constructed of a plastic such as nylon, rather than metal, to reduce the mass of the part.

Spring 172, which impinges at the forward end on shoulder 42 of frame 20, and at the rearward end on shoulder 344 of bolt 330, serves thereby to urge bolt 330 rearward within frame 20. When the gun is cocked and ready to fire, as in FIG. 12, bolt 330 and valve pin 304 are in longitudinal contact, with rearward face 334 of bolt 330 resting against shoulder 312 of valve pin 304.

Axially penetrating bolt 330 and extending rearward from forward face 332 is a forward longitudinal bore 346. Extending rearward from bore 346 to rear face 334 is a rear longitudinal bore 348. Bore 348 is of a diameter to fit slidably around and be substantially sealed by valve tube first section 314, completing thereby a recocking gas chamber 352 intermediate rear bolt face 334 and valve body 302.

Bore 348 is longer than first section 314, ensuring thereby that rearward face 334 can contact forward shoulder 312, as is shown in FIG. 12. Referring to FIG. 14, the length of section 314 is selected to place chamber 352 and bore 348 in fluid communication as striker-barrel 50 moves forward to the cocked position, and while bolt 330 remains in longitudinal contact with striker-barrel 50. First section 314 and bore 348 in combination thereby form a staging valve 354 which opens to permit the flow of gas from recocking chamber 352 to bore 348 as recocking is accomplished.

A single gas channel 356 for the passage of all compressed gas released by main valve 322 starts at valve seat 306, and continues in succession through the space between the exterior of third section 316 and the interior of bore 308, recocking gas chamber 352, staging valve 354, rear bore 348, and forward bore 346. Small arrows in FIG. 14 illustrate the flow of compressed gas through channel 356 when staging valve 354 opens.

With the elements of the fourth embodiment described, the manner of operation will be clarified. FIG. 12 shows the gun ready to fire, with striker-barrel 50 restrained in the cocked position by sear 24, bolt 330 in longitudinal contact with valve pin 304, main valve 322 closed, and projectile 62 within chamber 63.

Referring to FIG. 13, the operator has fired the gun by actuating the trigger mechanism (not shown), causing trigger sear 24 to translate downward, releasing striker-barrel 50 to move rearward to make longitudinal contact with and impact on bolt 330.

With striker-barrel 50, bolt 330, and valve pin 304 now in longitudinal contact, the inertia of rearward moving striker-barrel 50, plus the continued rearward urging of power spring 82, urge bolt 330 and valve pin 304 rearward. The forces urging clip seal 320 and attached valve pin 304 forward are momentarily overcome. Clip seal 320 and valve pin 304 move rearward, opening main valve 322 and allowing compressed gas to flow into chamber 352, as shown by the small arrows in FIG. 13.

The compressed gas now within chamber 352 acts against rear shoulder 313, and that portion of rear face 334 not in contact with enlarged section 310, to urge valve pin 304, bolt 330, and striker-barrel 50 forward. Valve spring 124, the compressed gas in reservoir 34 acting on cup seal 320, and drag due to compressed gas flowing forward alongside valve pin 304 also contribute to urging these components forward as valve pin 304 moves forward to the closed position of main valve 322.

Referring now to FIG. 14, the charge of compressed gas in chamber 352 continues to urge bolt 330 and striker-barrel 50 forward until this motion is stopped by the rearward urging of power spring 82, or by buffer ring 58. As striker-barrel 50 reaches the cocked position, staging valve 354 opens, allowing compressed gas to flow as shown by the small arrows in the figure and thereby propel projectile 62 forward as shown by the large arrow.

Once striker-barrel 50 has moved forward to the cocked position shown in FIGS. 12 and 14, sear 24 moves upward to engage sear notch 64, thereby restraining striker-barrel 50 in the cocked position until the operator again pulls the trigger.

With much of the gas in chamber now having escaped via channel 350, bolt 330 begins moving rearward in response to the urging of bolt spring 172. As bolt 330 moves rearward, gas remaining within chamber 352 is compressed, and can leak out via several paths, with the relative amounts dependent on the fit of the various parts. Some leaks through the small space between bolt rear section 340 and the inner surface of frame cavity 22. Some leaks through the space between valve tube first section 314 and bore 348. The relatively slow leakage of the gas from chamber 352 serves to moderate the rearward velocity of bolt 330. By virtue of this moderate velocity, and by virtue of bolt 330 being constructed of a low density material, the impact of bolt 330 as it makes longitudinal contact with valve pin 304 is not sufficient to reopen main valve 322.

With bolt 330 and striker-barrel 50 now returned to the cocked position shown in FIG. 12, projectile access opening 60 is again aligned with projectile feed tube 30 and is no longer obstructed by forward section 336 of bolt 330, permitting another projectile to descend into striker-barrel 50. The gun is again ready to fire.

As can be understood from the foregoing description, the fourth embodiment provides advantages of fewer and simpler parts, and efficient operation, as was seen in the first embodiment.

Although the description above contains many specificities, these should not be construed as limiting the scope of the invention but as merely providing illustrations of some of tile presently preferred embodiments of the invention. For example, the gun has been described as firing specific projectiles, namely paintballs or BBs, but may also be adapted to other projectiles such as metallic pellets, and to projectiles of a different size. Similarly, with appropriate selection of dimensions, masses, and spring characteristics, the gun can be made to function in a full automatic mode, so that projectiles continue to be propelled from the gun so long as the trigger is held in the actuated position.

Thus the scope of tile invention should be determined by the appended claims and their legal equivalents, rather than by the examples given.

I claim:

1. A gas projectile gun, comprising:

a gas reservoir having a main inlet valve;

a reciprocating barrel movable between a forwardly, cocked position and a rearwardly, main inlet valve opening position;

an expandable recocking chamber intermediate the main inlet valve and the barrel for receiving a portion of gas from the inlet valve to expand the chamber, expansion of the chamber causing a force to be applied to the barrel to move the barrel to the cocked position;

a first fluid channel for communicating gas directly from the reservoir to the barrel to propel the projectile; and, a second fluid channel communicating gas from the reservoir to the recocking chamber for expanding the chamber and recocking the barrel.

2. The gun of claim 1, including a reciprocating bolt mechanism intermediate the barrel and the main inlet valve to form the recocking chamber and translate gas pressure therein to recocking motion of the barrel.

3. The gun of claim 2, wherein the first fluid channel has a hollow valve tube between the reservoir and the barrel, wherein the second fluid channel is dimensioned to communicate a relatively smaller gas How than does the first fluid channel, and wherein the bolt mechanism has an elongated nose portion slidable within the barrel and slidably surrounding the valve tube.

4. The gun of claim 3, wherein the valve tube has back flow prevention means for preventing substantial gas flow from the recocking chamber to the barrel.

5. The gun of claim 1, wherein the barrel, recocking chamber and first fluid channel are substantially cylindrical, and wherein the barrel, recocking chamber, and first fluid channel are substantially concentric about a linear axis.

6. A gas powered projectile gun, comprising:

a movable barrel reciprocatable between a cocked position and a main valve striking position, and having a radially directed breach opening for receiving a projectile and an open rear end for receiving a bolt;

a gas reservoir having a main valve;

a hollow, movable bolt having open front and rear ends and being reciprocatable within the open rear end of the barrel between a breach sealing position and a breach opening position, the bolt and the main valve defining a recocking chamber;

a fluid channel for communicating gas from the reservoir to the recocking chamber; and, a control valve receivable in the open rear end of the bolt and having a first position for sealing the open rear end of the bolt until the barrel substantially reaches the cocked position, and also having a second position for releasing substantially all of the gas from tile rccocking chamber through the hollow bolt and to the barrel for expelling tile projectile, whereby the gun substantially recocks before the projectile is expelled.

7. The gun of claim 6, wherein the barrel, control valve, recocking chamber, and fluid channel are substantially cylindrical and concentric about a linear axis.

8. The gun of claim 6, wherein the control valve has a tapered forward end.

9. A gas-powered gun comprising:

a slidable striker-barrel having a cocked position;

a compressed gas reservoir, normally closed against the escape of gas by a valve assembly;

an inlet main valve within the valve assembly for releasing gas from the compressed gas reservoir;

a valve tube slidable within the valve assembly for actuating the inlet main valve;

a recock gas chamber intermediate the inlet main valve and the striker-barrel for receiving a portion of gas from the inlet main valve;

a primary channel for providing compressed gas to expel the projectile from the gun;

a secondary channel for providing compressed gas to the recock chamber to recock the gun;

a bolt within the frame substantially sealing the recock gas chamber and slidable from a rearward position of longitudinal contact with the valve tube to a forward position of longitudinal contact with the striker-barrel in the cocked position, whereby entry of gas into the recock chamber causes the bolt to slide forward toward said position of longitudinal contact with the striker-barrel to slide the striker-barrel to the cocked position; and bias means for urging the bolt rearward toward the position of longitudinal contact with the valve tube so that the striker-barrel can slide from the cocked position to a position of longitudinal impact on the bolt when the bolt is in the position of longitudinal contact with the valve tube to actuate the main inlet valve.

10. The gun of claim 9, wherein the secondary channel incorporates a secondary valve for allowing compressed gas to pass into the recocking chamber and prevent compressed gas from escaping from the recocking chamber to the primary channel.

11. A gas powered gun comprising:

a compressed gas reservoir, normally closed against the escape of gas by a valve assembly;

a main valve within the valve assembly for releasing gas from the compressed gas reservoir;

a valve tube slidable within the valve assembly for actuating the main valve;

a reciprocable striker-barrel slidably surrounding a portion of the valve tube and further being slidable between a cocked position and a position of impact on the valve tube, which impact actuates the main valve;

a recock gas chamber defined by the valve tube, valve assembly, striker-barrel and a gun frame;

a primary channel through the valve the and to the striker-barrel for providing compressed gas to expel the projectile from the gun; and a secondary channel for providing compressed gas to the recock chamber to recock the gun.

12. The gun of claim 11, wherein the secondary channel incorporates a secondary valve for allowing compressed gas to pass into the recocking chamber and preventing compressed gas from escaping from tile recocking chamber to the primary channel.

* * * * *

UNITED STATES PATENT AND TRADEMARK OFFICE

CERTIFICATE OF CORRECTION

PATENT NO. : 5,349,938

DATED : September 27, 1994

INVENTOR(S) : Farrell

It is certified that error appears in the above-indentified patent and that said Letters Patent is hereby corrected as shown below:

At column 14, line 43, insert the word "for" between channel communicating

At column 14, line 53, delete the word "How" and insert the word--flow--

At column 15, line 16, delete the word "tile" and insert the word--the--

At column 15, line 16, delete the word "rccocking" and insert the word --recocking--

At column 16, line 25, delete the word "reciprocable" and insert the word--reciprocatable- Column 16, line 32, delete the word "the" (2nd occurrence) should read —tube- At column 16, line 40, delete the word "tile" and insert the word--the--

Signed and Sealed this

Tenth Day of January, 1995

Bruce Lehman

*Attest:*

BRUCE LEHMAN

*Attesting Officer*

*Commissioner of Patents and Trademarks*